US011087704B2

(12) United States Patent
Zhang

(10) Patent No.: US 11,087,704 B2
(45) Date of Patent: Aug. 10, 2021

(54) LIQUID CRYSTAL PANEL DRIVING CIRCUIT AND LIQUID CRYSTAL PANEL

(71) Applicant: SHENZHEN CHINA STAR OPTOELECTRONICS SEMICONDUCTOR DISPLAY TECHNOLOGY CO., LTD., Guangdong (CN)

(72) Inventor: Xianming Zhang, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 472 days.

(21) Appl. No.: 16/072,665

(22) PCT Filed: May 15, 2018

(86) PCT No.: PCT/CN2018/086899

§ 371 (c)(1),
(2) Date: Jul. 25, 2018

(87) PCT Pub. No.: WO2019/205198

PCT Pub. Date: Oct. 31, 2019

(65) Prior Publication Data

US 2021/0082362 A1 Mar. 18, 2021

(30) Foreign Application Priority Data

Apr. 27, 2018 (CN) ..... 201810395567.1

(51) Int. Cl.
*G09G 3/36* (2006.01)

(52) U.S. Cl.
CPC ... *G09G 3/3648* (2013.01); *G09G 2300/0814* (2013.01)

(58) Field of Classification Search
CPC ..... G09G 3/3648; G09G 2300/0814
See application file for complete search history.

(56) References Cited

U.S. PATENT DOCUMENTS 8,395,325 B2 * 3/2013 Ye ..... H05B 45/38 315/192
2004/0052022 A1 * 3/2004 Laraia ..... H01L 27/0285 361/91.1

(Continued)

FOREIGN PATENT DOCUMENTS

CN 104701809 A 6/2015
CN 105048404 A * 11/2015

(Continued)

*Primary Examiner* — Carolyn R Edwards
(74) *Attorney, Agent, or Firm* — Leong C. Lei

(57) ABSTRACT

A liquid crystal panel driving circuit is provided. The circuit includes a pulse width modulation integrated circuit, including an input terminal, a first resistor, a second resistor, a comparator, a light-emitting diode, a latch, a RC circuit and a power supply voltage. Wherein the input terminal is connected to a ground terminal through the first resistor and the second resistor which are serially connected, a positive input terminal of the comparator is connected to a reference voltage, and a negative input terminal of the comparator is connected between the first resistor and the second resistor, an anode of the light-emitting diode is connected to an output terminal of the comparator, and a cathode of the light-emitting diode is connected to the latch, and an input terminal and an output terminal of the RC circuit are respectively connected to the power supply voltage and the latch.

7 Claims, 2 Drawing Sheets

10

(56) References Cited

U.S. PATENT DOCUMENTS

| | | | | |
|---|---|---|---|---|
| 2009/0066304 | A1* | 3/2009 | Nakabayashi | H02M 3/156 323/282 |
| 2011/0062884 | A1* | 3/2011 | Jang | H05B 41/285 315/291 |
| 2011/0221795 | A1* | 9/2011 | Ran | H05B 45/46 345/690 |
| 2014/0071035 | A1* | 3/2014 | Yu | G11C 19/28 345/100 |
| 2014/0176094 | A1* | 6/2014 | Yang | H02M 3/1582 323/266 |
| 2014/0246979 | A1* | 9/2014 | Zhang | H05B 45/3725 315/122 |
| 2015/0115914 | A1* | 4/2015 | Chang | H02M 3/156 323/271 |
| 2015/0221249 | A1* | 8/2015 | Kim | G09G 3/3413 345/212 |
| 2015/0326115 | A1* | 11/2015 | Chen | H02M 3/156 345/212 |
| 2017/0235404 | A1* | 8/2017 | Grivna | G06F 3/041661 345/174 |
| 2020/0112190 | A1* | 4/2020 | Honke | H02J 7/0063 |

FOREIGN PATENT DOCUMENTS

| | | | |
|---|---|---|---|
| CN | 105048404 | A | 11/2015 |
| CN | 107301849 | A | 10/2017 |
| GB | 2039170 | B | 6/1983 |

* cited by examiner

10

LIQUID CRYSTAL PANEL DRIVING CIRCUIT AND LIQUID CRYSTAL PANEL

RELATED APPLICATIONS

The present application is a National Phase of International Application Number PCT/CN2018/086899, filed May 15, 2018, and claims the priority of China Application No. 201810395567.1, filed Apr. 27, 2018.

FIELD OF THE INVENTION

The present invention relates to an electric circuit field, and more particularly to a liquid crystal panel driving circuit and a liquid crystal panel.

BACKGROUND OF THE INVENTION

With the development of display technology, more and more people are pursuing realistic effects of stereoscopic display for televisions, movies, etc. The liquid crystal panel is the main component for realizing stereoscopic display. The liquid crystal panel driving circuit for driving the liquid crystal panel to operate includes a pulse width modulation integrated circuit (PWM IC). For a commonly used PWM IC, it has an under voltage lock out (UVLO) voltage, that is, when an input voltage is above the UVLO value, the PWM IC starts to operate. When the input voltage falls below the UVLO value, the PWM IC is turned off and there is no longer any output.

However, during the use of the TV, we encountered unstable conditions in the main power supply, resulting in a sudden drop in voltage and then resumed. Since this voltage droop was too short, the PWM IC was only momentarily turned off and then restarted. At this time, each output voltage cannot be discharged completely. Especially for the timing controller (TCON), if the power supply voltage VDD 3.3V and the core voltage Vcore are not completely discharged, when restarting, a timing disorder may generate, resulting in abnormal output, abnormal image, and even causes irreversible damage to the LCD panel and seriously affects the user experience.

Therefore, it is necessary to provide a new liquid crystal panel driving circuit to solve the above problems.

SUMMARY OF THE INVENTION

The purpose of the present invention is to provide a liquid crystal panel driving circuit with good reliability and excellent customer experience.

In order to achieve the above purpose, the present invention provides a liquid crystal panel driving circuit, comprising: a pulse width modulation integrated circuit, wherein the pulse width modulation integrated circuit includes an input terminal, a first resistor, a second resistor, a comparator, a light-emitting diode, a latch, a RC circuit and a power supply voltage; wherein the input terminal is connected to a ground terminal through the first resistor and the second resistor which are serially connected; wherein a positive input terminal of the comparator is connected to a reference voltage, and a negative input terminal of the comparator is connected between the first resistor and the second resistor; wherein an anode of the light-emitting diode is connected to an output terminal of the comparator, and a cathode of the light-emitting diode is connected to the latch; wherein an input terminal and an output terminal of the RC circuit are respectively connected to the power supply voltage and the latch.

Wherein the RC circuit includes a third resistor and a capacitor, a first end of the third resistor is connected to the power supply voltage, a second end of the third resistor is connected to a first end of the capacitor; the second end of the third resistor and a second end of the capacitor are electrically connected to the latch.

Wherein the latch includes a first transistor, a second transistor, a fourth resistor, and a fifth resistor wherein a base of the first transistor is connected to a collector of the second transistor, and an emitter of the first transistor is connected to the second end of the third resistor of the RC circuit, a collector of the first transistor is connected to the ground terminal via the fifth resistor, and the collector of the first transistor is connected to the cathode of the light-emitting diode; wherein a base of the second transistor is connected to the collector of the first transistor and serves as an output terminal of the liquid crystal panel driving circuit, and an emitter of the second transistor is connected to second end of the capacitor of the RC circuit, and is also connected to the ground terminal, a first end of the fourth resistor is connected to the base of the first transistor, and a second end of the fourth resistor is connected to the emitter of the first transistor.

Wherein the liquid crystal panel driving circuit further includes a logic NOT gate and a logic AND gate, the output terminal is connected to an input of the logic NOT gate, a first input of the logic AND gate is connected to the output of the logic NOT gate, a second input of the logic AND gate is connected to a low level voltage signal, and the output of the logic AND gate is used as the output of the liquid crystal panel driving circuit.

Wherein the liquid crystal panel driving circuit adjusts a discharging time by adjusting values of the third resistor and the capacitor.

Wherein the liquid crystal panel driving circuit adjusts a discharging time by adjusting values of the third resistor and the capacitor.

Wherein the first transistor and the second transistor are all PNP type transistors.

Wherein the first transistor and the second transistor are all PNP type transistors.

Wherein the power supply voltage is 3.3V.

The present invention also provides a liquid crystal panel, comprising the above liquid crystal panel driving circuit.

Compared with the related art, the liquid crystal panel driving circuit of the present invention realizes an RC circuit by using the power supply voltage, and fully charges the capacitor in the RC circuit during normal operation of the liquid crystal panel driving circuit such that the output terminal is a high level, when the voltage at the output terminal suddenly drops and falls below the under voltage lockout voltage, through the action of the latch and the logic NOT gate and the logic AND gate, The output of the liquid crystal panel driving circuit is turned off, and only after the power supply voltage falls below the safety point, the ability to start again is generated, which ensures that the liquid crystal panel driving circuit works normally the output timing will not be disordered. Accordingly, the present can enhance the reliability and user experience of the liquid crystal panel driving circuit.

DETAILED DESCRIPTION OF PREFERRED EMBODIMENTS

The present invention will be further described below with reference to the accompanying drawings and embodiments.

Figure 1:
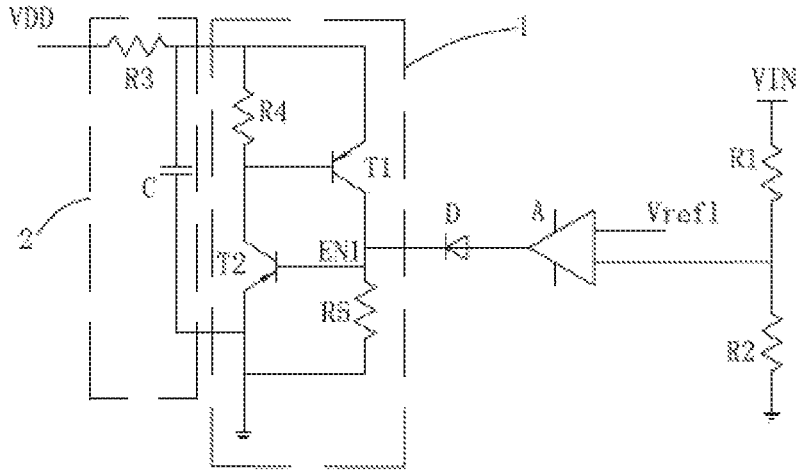
FIG. 1 is a circuit structure diagram of a liquid crystal panel driving circuit according to the present invention.
Figure 2:
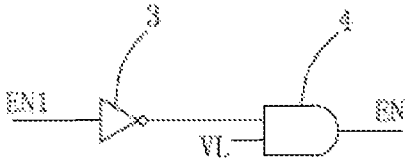
FIG. 2 is a schematic diagram of a circuit structure of an output terminal of a liquid crystal panel driving circuit according to the present invention.

With reference to FIG. 1, which is a schematic diagram of a circuit diagram of a driving circuit of a liquid crystal panel according to the present invention. The present invention provides a liquid crystal panel driving circuit including a pulse width modulation integrated circuit 10. The pulse width modulation integrated circuit 10 includes an input terminal VIN, a first resistor R1, a second resistor R2, a comparator A, a light-emitting diode D, a latch 1, a RC circuit 2 and a power supply voltage VDD.

The input terminal VIN is connected to a ground terminal through the first resistor R1 and the second resistor R2 which are serially connected. A positive input terminal of the comparator A is connected to a reference voltage Vref1, and a negative input terminal of the comparator A is connected between the first resistor R1 and the second resistor R2. An anode of the light-emitting diode D is connected to an output terminal of the comparator A, and a cathode of the light-emitting diode D is connected to the latch 1.

The operation principle of the liquid crystal panel driving circuit is: when the signal of the input terminal VIN is decreased, the liquid crystal panel driving circuit detects main output voltage and determines whether the output voltage has fallen to a safe point. The next reboot can be performed to ensure that the output timing of the voltage is not disturbed and normal operation is guaranteed. In this embodiment, the liquid crystal panel driving circuit may specifically include a pulse width modulation integrated circuit 10, and the specific circuit is as follows:

An input terminal and an output terminal of the RC circuit 2 are respectively connected to the power supply voltage VDD and the latch 1. Specifically, the power supply voltage VDD is 3.3V.

In this embodiment, the latch 1 includes a first transistor T1, a second transistor, a fourth resistor R4, and a fifth resistor R5. More preferably, the first transistor T1 and the second transistor T2 are all PNP type transistors.

In the present embodiment, the RC circuit 2 includes a third resistor R3 and a capacitor C. That is, the third resistor R3 and the capacitor C commonly form the RC circuit 2. Of course, the structure of the RC circuit 2 is not limited to this. A first end of the third resistor R3 is connected to the power supply voltage VDD, a second end of the third resistor R3 is connected to a first end of the capacitor C, and the second end of the third resistor R3 and a second end of the capacitor C are electrically connected to the latch 1 respectively. A base of the first transistor T1 is connected to a collector of the second transistor T2, and an emitter of the first transistor T1 is connected to the second end of the third resistor R3 of the RC circuit 2. A collector of the first transistor T1 is connected to the ground terminal via the fifth resistor R5, and the collector of the first transistor T1 is connected to the cathode of the light-emitting diode D.

A base of the second transistor T2 is connected to the collector of the first transistor T1 and serves as an output terminal EN1 of the liquid crystal panel driving circuit, and an emitter of the second transistor T2 is connected to second end of the capacitor C of the RC circuit 2, and is also connected to the ground terminal, a first end of the fourth resistor R4 is connected to the base of the first transistor T1, and a second end of the fourth resistor R4 is connected to the emitter of the first transistor T1.

More preferably, the liquid crystal panel driving circuit further includes a logic NOT gate 3 and a logic AND gate 4, the output terminal EN1 is connected to an input of the logic NOT gate 3. A first input of the logic AND gate 4 is connected to the output of the logic NOT gate 3, a second input of the logic AND gate 4 is connected to a low level voltage signal VL. The output of the logic AND gate 4 is used as the output of the liquid crystal panel driving circuit. The above circuit structure makes the output signal of the output terminal EN1 to go through the logic NOT gate 3 and then output the signal through the logic AND gate 4 together with the low level voltage signal VL.

In this embodiment, the liquid crystal panel driving circuit can adjust a discharging time by adjusting values of the third resistor R3 and the capacitor C.

The liquid crystal panel driving circuit of the present invention uses the power supply voltage VDD and implements the RC circuit 2 to fully charge the capacitor C in the RC circuit 2 during normal operation of the liquid crystal panel driving circuit. At this time, the comparator A outputs a low level, the latch 1 formed by the first transistor T1 and the second transistor T2 does not operate, and the output EN1 is a high level.

When the voltage at the output terminal VIN suddenly drops and falls below an Under Voltage Lock Out (UVLO) voltage, the voltage is lower than the reference voltage Vref1, and the output of the comparator A is a high level, and all of the voltages will turn off. At this time, the second transistor T2 is turned on. Then, the first transistor T1 is turned on, and the latch 1 starts to work until the voltage of the power supply voltage VDD drops to fail to support the operation of the latch 1. At this time, the voltage of the output terminal EN1 gradually approaches 0.

When the liquid crystal panel driving circuit is turned on again, the output terminal of EN1 still outputs 0, the latch 1 does not work, and the power supply voltage VDD is 0. At this time, the output EN1 of the VDD starts to be a high level, the entire liquid crystal panel driving circuit starts to operation normally.

By using the liquid crystal panel driving circuit of the present invention, if the voltage of the input terminal VIN drops abruptly below the UVLO, through the latch 1, the logic NOT gate 3 and the logic AND gate 4, turning off all of the liquid crystal panel driving circuit (i.e., the PWM IC), the liquid crystal panel drive circuit has the ability to turn on again only when the voltage of the power supply voltage VDD falls below the safety point. Regardless of whether the input terminal VIN voltage exceeds UVLO or below UVLO, the reboot can be started only if exceeding the UVLO again. Through the liquid crystal panel driving circuit, all the output voltages of the liquid crystal panel driving circuit can be ensured to be turned on for the next time after the output voltage drops to the safe point, so as to ensure that the output timing is not disordered and the normal operation is ensured.

In order to further improve the reliability thereof, the liquid crystal panel driving circuit may adjust the discharging time by adjusting the values of the third resistor R3 and the capacitor C, so as to ensure that the output voltage is completely discharged when rebooting again.

Compared with the related art, the liquid crystal panel driving circuit of the present invention realizes an RC circuit by using the power supply voltage, and fully charges the capacitor in the RC circuit during normal operation of the liquid crystal panel driving circuit such that the output terminal is a high level, when the voltage at the output terminal suddenly drops and falls below the under voltage lockout voltage, through the action of the latch and the logic NOT gate and the logic AND gate, The output of the liquid crystal panel driving circuit is turned off, and only after the power supply voltage falls below the safety point, the ability to start again is generated, which ensures that the liquid crystal panel driving circuit works normally the output timing will not be disordered. Accordingly, the present can enhance the reliability and user experience of the liquid crystal panel driving circuit.

The above embodiment does not constitute a limitation of the scope of protection of the present technology solution. Any modifications, equivalent replacements and improvements based on the spirit and principles of the above embodiments should also be included in the protection scope of the present technology solution.

What is claimed is:

1. A liquid crystal panel driving circuit, comprising:

a pulse width modulation integrated circuit, wherein the pulse width modulation integrated circuit includes an input terminal, a first resistor, a second resistor, a comparator, a light-emitting diode, a latch, a RC circuit and a power supply voltage;

wherein the input terminal is connected to a ground terminal through the first resistor and the second resistor which are serially connected;

wherein a positive input terminal of the comparator is connected to a reference voltage, and a negative input terminal of the comparator is connected between the first resistor and the second resistor;

wherein an anode of the light-emitting diode is connected to an output terminal of the comparator, and a cathode of the light-emitting diode is connected to the latch;

wherein an input terminal and an output terminal of the RC circuit are respectively connected to the power supply voltage and the latch;

wherein the RC circuit includes a third resistor and a capacitor, a first end of the third resistor is connected to the power supply voltage, a second end of the third resistor is connected to a first end of the capacitor; the second end of the third resistor and a second end of the capacitor are electrically connected to the latch; wherein the power supply voltage is a fixed voltage, and the capacitor of the RC circuit is fully charged by the fixed voltage; and wherein the RC circuit defines a discharging time that the RC circuit discharges from the fully-charged condition of the capacitor to bring a voltage at an output of the latch toward null due to a drop of a voltage applied the input terminal, and the discharging time is adjustable through adjusting values of the third resistor and the capacitor.

2. The liquid crystal panel driving circuit according to claim 1, wherein the latch includes a first transistor, a second transistor, a fourth resistor, and a fifth resistor;

wherein a base of the first transistor is connected to a collector of the second transistor, and an emitter of the first transistor is connected to the second end of the third resistor of the RC circuit, a collector of the first transistor is connected to the ground terminal via the fifth resistor, and the collector of the first transistor is connected to the cathode of the light-emitting diode;

wherein a base of the second transistor is connected to the collector of the first transistor and serves as an output terminal of the liquid crystal panel driving circuit, and an emitter of the second transistor is connected to second end of the capacitor of the RC circuit, and is also connected to the ground terminal, a first end of the fourth resistor is connected to the base of the first transistor, and a second end of the fourth resistor is connected to the emitter of the first transistor.

3. The liquid crystal panel driving circuit according to claim 2, wherein the liquid crystal panel driving circuit further includes a logic NOT gate and a logic AND gate, the output terminal is connected to an input of the logic NOT gate, a first input of the logic AND gate is connected to the output of the logic NOT gate, a second input of the logic AND gate is connected to a low level voltage signal, and the output of the logic AND gate is used as the output of the liquid crystal panel driving circuit.

4. The liquid crystal panel driving circuit according to claim 2, wherein the first transistor and the second transistor are all PNP type transistors.

5. The liquid crystal panel driving circuit according to claim 3, wherein the first transistor and the second transistor are all PNP type transistors.

6. The liquid crystal panel driving circuit according to claim 1, wherein the power supply voltage is 3.3V.

7. A liquid crystal panel, comprising a liquid crystal panel driving circuit as claimed in claim 1.

* * * * *